United States Patent [19]

Emmenthal et al.

[11] 4,414,944

[45] Nov. 15, 1983

[54] DEVICE FOR CONTINUOUS INJECTION OF A MIXTURE CONSISTING OF FUEL AND AIR INTO THE INTAKE LINE (OR MANIFOLD) OF AN INTERNAL COMBUSTION ENGINE

[75] Inventors: Klaus-Dieter Emmenthal; Otto Schäfer, both of Wolfsburg; Rudolf-Helmut Strozyk, Helmstedt, all of Fed. Rep. of Germany

[73] Assignee: Volkswagenwerk Aktiengesellschaft, Wolfsburg, Fed. Rep. of Germany

[21] Appl. No.: 384,576

[22] Filed: Jun. 3, 1982

Related U.S. Application Data

[63] Continuation of Ser. No. 100,444, Dec. 5, 1979, abandoned.

[30] Foreign Application Priority Data

Dec. 20, 1978 [DE] Fed. Rep. of Germany ..... 2854988

[51] Int. Cl.[3] ..... F02D 33/00

[52] U.S. Cl. ..... 123/339; 123/531; 123/533; 261/50 A

[58] Field of Search ..... 123/531, 533, 339, 443; 261/50 A, 51

[56] References Cited

U.S. PATENT DOCUMENTS 3,198,498 8/1965 Mennesson ..... 201/50 A

FOREIGN PATENT DOCUMENTS 1361806 4/1964 Fed. Rep. of Germany .
1243917 7/1967 Fed. Rep. of Germany .
1291933 4/1969 Fed. Rep. of Germany .
2548226 2/1977 Fed. Rep. of Germany .
2515463 10/1977 Fed. Rep. of Germany .
1234576 10/1960 France .
1309918 10/1962 France .
1360294 3/1964 France .
854568 11/1960 United Kingdom .

*Primary Examiner*—William A. Cuchlinski, Jr.
*Assistant Examiner*—Carl Stuart Miller
*Attorney, Agent, or Firm*—Brumbaugh, Graves, Donohue & Raymond

[57] ABSTRACT

A fuel injection device for continuously injecting the mixture of fuel and air into the cylinders of an internal combustion engine has an intake pipe, an arbitrarily adjustable throttle flap, and a venturi in the intake pipe at a point upstream of the throttle flap. An air channel branches off from the narrowest point of the venturi and a main fuel metering arrangement supplies fuel to the mixing chamber portion of the channel substantially as a function of the air pressure at the venturi. A suction line is connected to receive the air and fuel from the mixing chamber in the channel and an idling fuel metering arrangement supplies fuel under constant pressure to the line during idling. A fuel delivery pump is connected to receive the air and fuel mixture in the line and to supply the mixture to the points of injection associated with the several cylinders of the engine. Means are provided for drawing additional fuel from the idling fuel metering arrangement by the action of negative pressure near the exit orifice of the metering arrangement during periods of low partial engine loads.

6 Claims, 1 Drawing Figure

DEVICE FOR CONTINUOUS INJECTION OF A MIXTURE CONSISTING OF FUEL AND AIR INTO THE INTAKE LINE (OR MANIFOLD) OF AN INTERNAL COMBUSTION ENGINE

This is a continuation of application Ser. No. 100,444, filed Dec. 5, 1979 now abandoned.

BACKGROUND OF THE INVENTION

The present invention relates to a device for the continuous injection of a mixture consisting of fuel and air into the cylinders of an internal combustion engine. A fuel injection system of this type, in which a mixture of both air and fuel are supplied by the fuel delivery pump (rather than liquid fuel only) is described in commonly ownded U.S. Pat. application Ser. No. 932,493, filed Aug. 10, 1978 now U.S. Pat. No. 4,368,714. As described therein, a venturi is arranged in the air intake pipe upstream of the throttle flap. An air channel branches off from the narrowest point of the venturi to supply the needed air for the fuel delivery pump. A fuel metering device supplies fuel into the mixing chamber portion of this channel substantially as a function of existing pressure difference between the instantaneous pressure at the venturi and atmosphere, or in other words, the rate of air flow through the channel (since with increasing air flow rate the suction created on the fuel metering output line increases). A fuel delivery pump is connected to receive the air and fuel existing from the channel and to supply the mixture to the points of injection associated with the several cylinders of the engine. This particular type of injection system is advantageous since the fuel is mixed with a portion of the air flow in the intake pipe prior to the injection into the main air flow. This results not only in a more effective preparation of the fuel, since it is more thoroughly atomized, but also obviates the difficulties of accurate proportioning and adequate dispersion which normally occur in straight liquid injection (where the liquid fuel is dispersed through an injection nozzle), especially at low rates of injection.

An injection system of this type, in addition to the main fuel proportioning apparatus which supplies fuel as a function of load between partial and full load, generally has a separate idling fuel metering system, operative in idling only. Difficulties can arise in such injection systems, however, especially in the so-called transition range, that is a transition from the idling load, wherein fuel is supplied from the idling metering system, to partial full load when fuel is supplied from the main fuel metering system. To achieve a smooth engine performance during transition, generally an additional fuel enrichment is required.

SUMMARY OF THE INVENTION

The present invention is a fuel injection system of the general type described above, which includes apparatus, simple in construction, which improves the transitional performance of the engine. With this arrangement, the flow curve, that is, the ratio of air flow rate to fuel injection flow rate, plotted against intake air flow rate, is suitably varied to improve engine performance in the transition range.

In accordance with the present invention, additional fuel may be drawn from the idling fuel metering system during low partial engine load by the action of negative pressure near the exit orifice of the idling fuel metering system. Since this additional fuel is drawn from the idling fuel metering system, a desired change in the fuel flow curve can be obtained in the lower partial load range without the need for changing the main fuel metering means control pressure which is generated in the venturi apparatus.

The additional flow of fuel is provided by an apparatus wherein a ventilation line is associated with the exit orifice of the idling fuel metering system and connected to a point of at least intermittent negative pressure on the intake pipe of the engine. This point on the intake pipe is a port which is located within the region of the swing of a throttle flap so that when the throttle flap is closed the port is shut off from the portion of the intake pipe which is downstream from the throttle flap. When the throttle flap is in this closed position, the port is not subject to negative pressure. However, when the throttle is at least partly opened, the port communicates with that portion of the intake pipe which is downstream from the throttle flap.

In order to be able to adjust the control pressure which is supplied to the idling fuel metering system, a gauge nozzle may be arranged in the line which connects the port with the ventilation line and, additionally, the ventilation line may communicate with the atmosphere by way of an air correction nozzle. Additionally, the control pressure, and hence fuel supply, may be adjusted in the transition range as a function of the temperature which is achieved. This adjustment may be made by connecting the ventilation line to a point of atmospheric pressure in the intake pipe by way of another line, this other line being equipped with a throttle member which is temperature controlled.

For a better understanding of the invention, reference may be made to the drawing which accompanies the application and to the following Detailed Description thereof.

DETAILED DESCRIPTION OF THE PREFERRED EMBODIMENT

Figure 1:
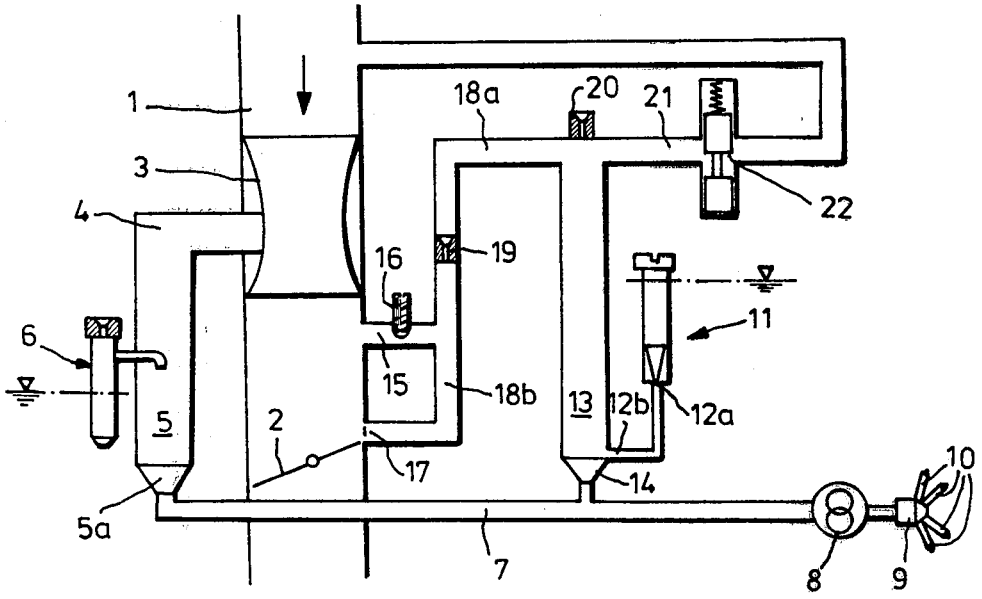
FIG. 1 is a schematic drawing of an embodiment of a fuel injection system according to the present invention.

In the drawing, a fuel injection system for a mixture-compressing Otto engine includes an intake pipe 1 having a venturi 3 and a throttle flap 2 which is adjustable at will by actuating an accelerator pedal (not shown). At the narrowest point of the venturi 3, an air channel 4 branches off diverting a portion of the air flow from the intake 1 to a mixing chamber 5. As shown in greater detail in the aforementioned U.S. patent application Ser. No. 932,493 now U.S. Pat. No. 4,368,714, which is incorporated herein by reference, a main fuel metering system 6 communicates with the mixing chamber 5 for supplying fuel between partial and full loads. The system provides fuel for the suction line 7 by way of a cross-sectional constriction 5*a* as a function of the negative pressure obtained at the narrowest point of the venturi apparatus 3. The proportional fuel and air mixture is then supplied by a fuel delivery pump 8 to a distributor 9 and injection lines 10 associated with several cylinders of the engine (not shown). As was noted in the aforementioned U.S. patent application Ser. No. 932,493 now U.S. Pat. No. 4,368,714, the delivery of a mixture of fuel and air affords a better dispersion of the proportional fuel even at low fuel flow rates.

While the fuel which is required to operate the engine between the partial load range and the full load condition is proportioned substantially by the main fuel metering system 6, when the engine is idling an idling fuel metering system 11 becomes operative. During that period the flow of fuel under constant pressure, proportioned at a nozzle 12*a*, enters from an orifice 12*b* into a ventilation line 13. The ventilation line is connected by way of a constriction 14 to the suction line 7 which delivers the mixture of fuel and air to the fuel delivery pump 8. In idling condition, the ventilation line 13 communicates by way of a connecting line 18*a* and a second connecting line 15 with a port on the intake pipe 1 which is upstream from the throttle flap 2. An adjusting screw 16 serves to adjust the idling air flow.

In the transition range, that is during periods of low partial loads, the supply of fuel from the main fuel metering means 6 is inadequate. However, the fuel can be enriched by utilizing the idling fuel metering system. This utilization occurs when the connection line 18*a* communicates by way of another connecting line 18*b* with at least one port 17 within the range of swing of the throttle flap 2.

In the embodiment shown in FIG. 1, two ports 17 are provided. The ports are arranged so that when the throttle flap is closed they are shut off from the portion of the intake pipe which is downstream from the throttle flap and which is under negative pressure. However, when the throttle flap is at least partially opened, the ports communicate with that portion of the intake pipe which is downstream from the throttle flap. In this manner, at small angles of aperture of the throttle flap, negative pressure is applied to the ventilation line 13 by way of the ports and connecting lines. As a result, a negative pressure is obtained at the exit orifice 12*b* of the idling fuel metering system 11 and this increases the flow of fuel. By suitable design of the ports 17, and/or of a gauge nozzle 19 arranged in the connecting line 18*a*, and an air correction nozzle 20 connecting the ventilation line 13 with the atmosphere, the negative pressure may be so adjusted as to cause the idling metering system to supply additional fuel thereby adjusting the fuel flow curve.

It is also possible to adjust, as a function of temperature, the control pressure and hence the fuel flow proportion in the transition range. The ventilation line 13 may be connected by way of still another line 21 to a port in the intake pipe 1 at atmospheric pressure. A temperature controlled throttle member 22 can be located in the additional line 21 so that it can shut off the connecting line 21 when the engine is cold, and open it increasingly with raising engine temperature. In this manner the negative pressure action on the ventilation line 13 in the transition range will decline with raising engine temperature and the additional flow of fuel will decrease. For this reason the throttle member 22 could, for example, be actuated by a thermostatic mechanism which is acted upon by the cooling water of the engine.

While representative applications and embodiments of the invention have been described, those skilled in the art will recognize that many variations and modifications of such embodiments may be made without departing from the spirit of the invention and it is intended to claim all such variations and modifications as fall within the true scope of the invention.

We claim:

1. In an apparatus for continuously injecting a mixture of fuel and air into the cylinders of an internal combustion engine, said apparatus including an air intake pipe having an arbitrarily adjustable throttle flap arranged therein, a venturi in said intake pipe at a point upstream of said throttle flap, with an air channel branching off from the narrowest point of the venturi, a main fuel metering means for supplying fuel to the mixing chamber portion of said channel substantially as a function of the air pressure at said venturi, a suction line connected to receive the air and fuel from the mixing chamber in said channel, an idling fuel metering means for supplying fuel under constant pressure to said line during idling, and a fuel delivery pump connected to receive the air and fuel mixture in said line and to supply said mixture to the points of injection associated with the several cylinders of the engine; the improvement comprising a ventilation line associated with an exit orifice of the idling fuel metering means and communicating with a point of at least intermittent negative pressure on said intake pipe of the engine for drawing additional fuel from the idling fuel metering means, said point on said intake pipe comprising at least one port which is within the range of swing of said throttle flap and which, when the throttle flap is closed, is shut off from the portion of said intake pipe situated downstream from said throttle flap and which is acted upon by negative pressure, but wherein said port communicates with said lower portion of the intake pipe, which is acted upon by negative pressure, when the throttle flap is at least partly opened.

2. The improvement according to claim 1, comprising a gauge nozzle located in the line connecting said port to said ventilation line.

3. The improvement according to claim 1 or 2, wherein said ventilation line communicates with the atmosphere by way of an air correction nozzle.

4. The improvement according to claim 1, or 2 wherein said ventilation line communicates with the atmosphere by way of an air correction nozzle and wherein said ventilation line communicates by way of a different connecting line with a point in the intake pipe at atmospheric pressure, and wherein a temperature controlled throttling member is located in said different connecting line.

5. In an apparatus for continuously injecting a mixture of fuel and air into the cylinders of an internal combustion engine, said apparatus including an air intake pipe having an arbitrarily adjustable throttle flap arranged therein, a venturi in said intake pipe at a point upstream of said throttle flap, with an air channel branching off from the narrowest point of the venturi, a main fuel metering means for supplying fuel to the mixing chamber portion of said channel substantially as a function of the air pressure at said venturi, a suction line connected to receive the air and fuel from the mixing chamber in said channel, an idling fuel metering means separate from said main fuel metering means for supplying fuel under constant pressure to said line during idling, and a fuel delivery pump connected to receive the air and fuel mixture in said line and to supply said mixture to the points of injection associated with the several cylinders of the engine; the improvement comprising means for drawing additional fuel from the idling fuel metering means by the action of increased negative pressure near the exit orifice of said metering means during periods of low partial engine loads.

6. The improvement according to claim 5, comprising a ventilation line associated with said exit orifice of the idling fuel metering means and communicating with a point of at least intermittent negative pressure on said intake pipe of the engine.

* * * * *